US006976357B1

(12) United States Patent
Pfaff

(10) Patent No.: US 6,976,357 B1
(45) Date of Patent: Dec. 20, 2005

(54) CONDUIT LOSS COMPENSATION FOR A DISTRIBUTED ELECTROHYDRAULIC SYSTEM

(75) Inventor: Joseph L. Pfaff, Wauwatosa, WI (US)

(73) Assignee: HUSCO International, Inc., Waukseha, WI (US)

( * ) Notice: Subject to any disclaimer, the term of this patent is extended or adjusted under 35 U.S.C. 154(b) by 30 days.

(21) Appl. No.: 10/874,618

(22) Filed: Jun. 23, 2004

(51) Int. Cl.[7] ..... F15B 13/04
(52) U.S. Cl. ..... 60/422; 60/445
(58) Field of Search ..... 60/422, 433, 445, 60/452, 459; 91/459

(56) References Cited

U.S. PATENT DOCUMENTS 6,173,573 B1 * 1/2001 Kamada ..... 60/422
6,328,275 B1 12/2001 Yang et al.
6,715,402 B2 * 4/2004 Pfaff et al. ..... 91/526
6,718,759 B1 4/2004 Tabor
6,775,974 B2 * 8/2004 Tabor ..... 60/422

* cited by examiner

*Primary Examiner*—Thomas E. Lazo
(74) *Attorney, Agent, or Firm*—George E. Haas; Quarles & Brady LLP

(57) ABSTRACT

A plurality of hydraulic actuators are connected by valve assemblies to fluid supply and return conduits. Desired operating velocities are specified for the hydraulic actuators and used to define the amounts of fluid flow required by each actuator to move at the respective velocity. Provide the requisite flow amounts, fluid at related pressures must be provided at the different hydraulic actuators. In order for those pressures to occur, a pump has to furnish fluid at a greater pressure to allow for supply conduit losses. A process is provided for determining the pressure that the pump must provide to satisfy the greatest pressure that is necessary for the desired operation of all the hydraulic actuators.

24 Claims, 3 Drawing Sheets

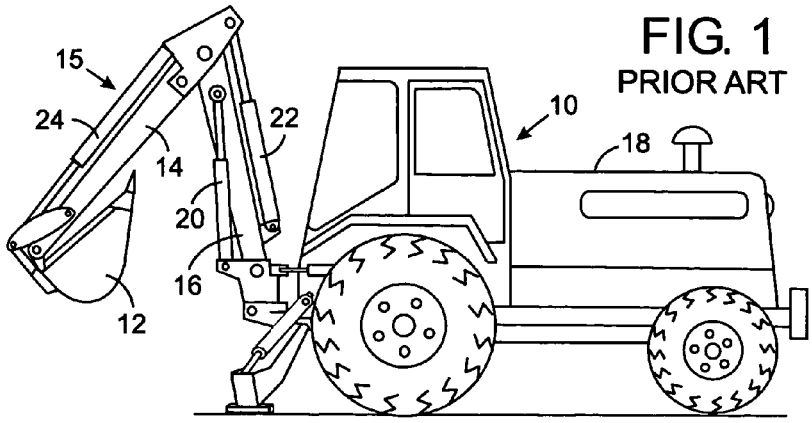
FIG. 1
PRIOR ART
FIG. 2
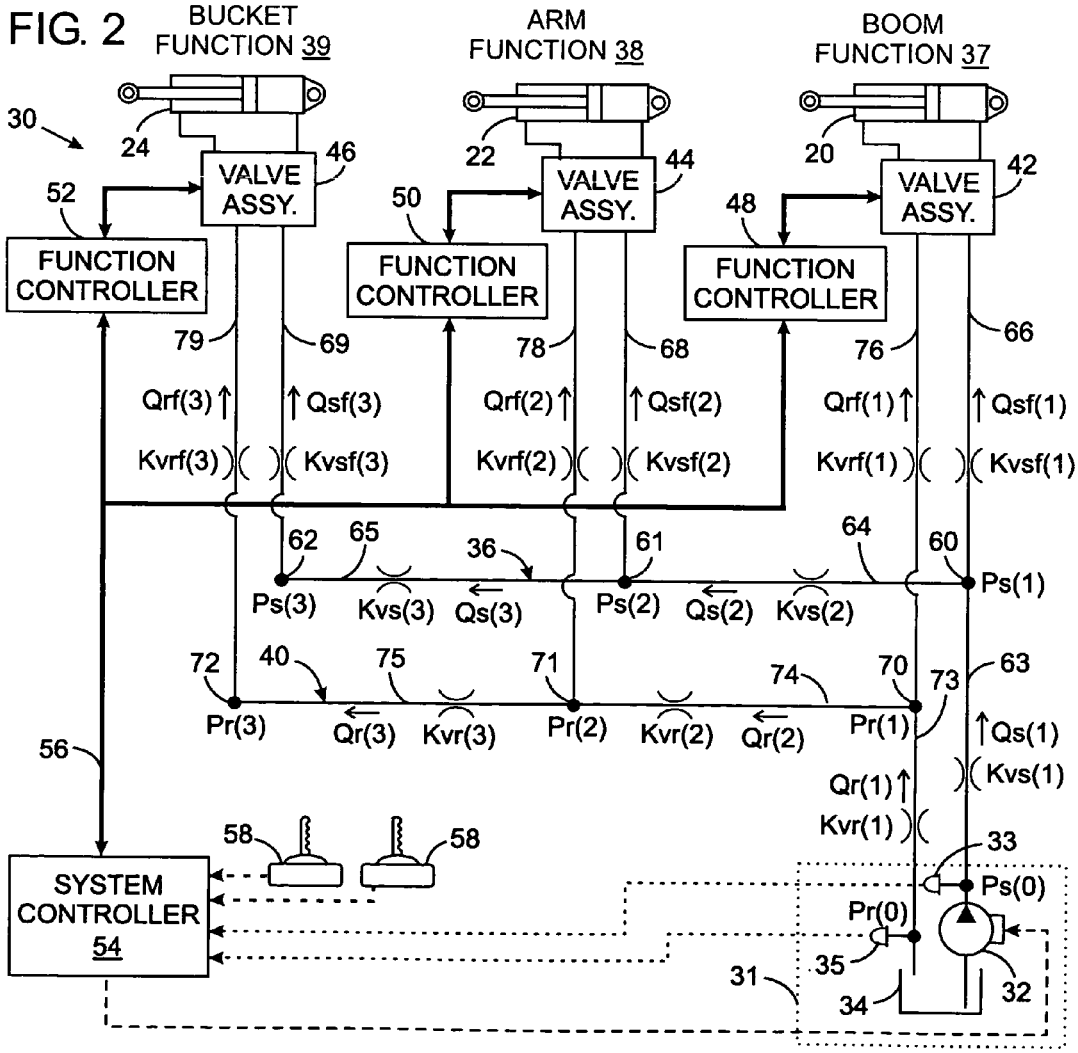

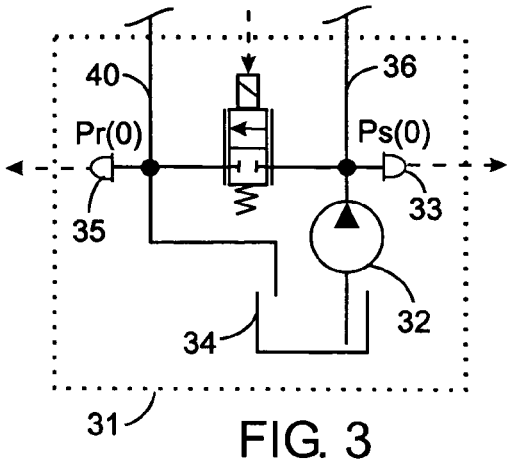
FIG. 3
FIG. 5
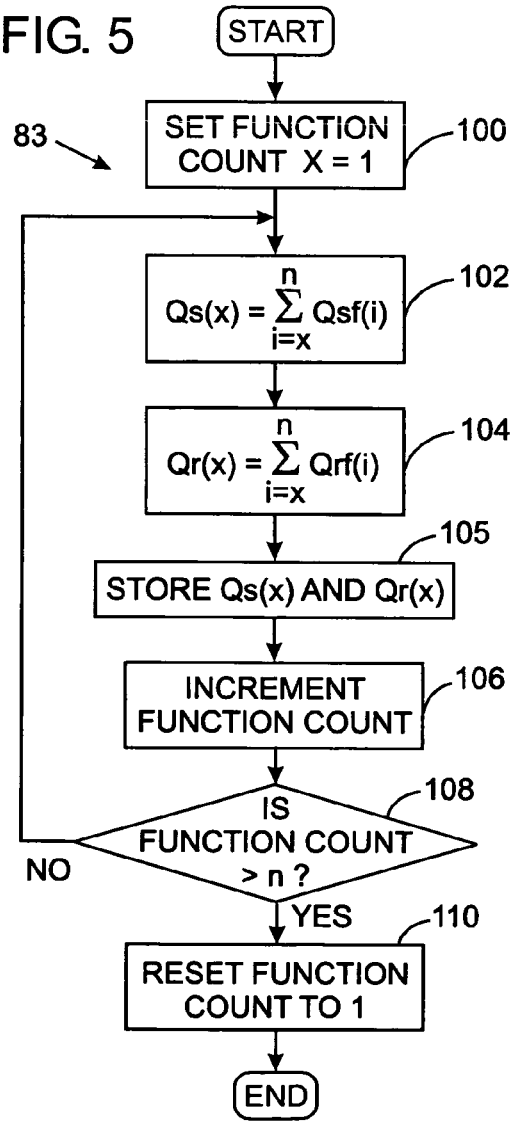

CONDUIT LOSS COMPENSATION FOR A DISTRIBUTED ELECTROHYDRAULIC SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems for powering machinery, and more particularly to distributed hydraulic systems in which each hydraulic actuator is operated by a control valve assembly located relatively close to the associated actuator.

2. Description of the Related Art

With reference to FIG. 1, a backhoe 10 is a well known type of earth moving equipment that has a bucket 12 rotatably attached to the end of an arm 14 which in turn is pivotally coupled by a boom 16 to a tractor 18, thereby forming a boom assembly 15. A hydraulic boom cylinder 20 raises and lowers the boom 16 with respect to the tractor 18 and a hydraulic arm cylinder 22 pivots the arm 14 about the end of the boom. The bucket 12 is rotated at the remote end of the arm 14 by a hydraulic bucket cylinder 24.

Traditionally, the boom assembly 15 is controlled by valves located within the chassis frame of the tractor 18 and mechanically connected to levers which the operator manipulates to independently move the boom, arm and bucket. As separate valve is provided for each of the cylinders 20, 22 and 24 on the boom assembly 15. Operating one of the valves controls the flow of pressurized hydraulic fluid from a pump on the tractor to the associated cylinder and controls the return of fluid from that cylinder back to the tank on the tractor. A separate pair of hydraulic conduits runs from each cylinder along the boom assembly to the respective valve on the chassis frame. Each of these conduits is subject to fatigue as they flex with motion of the boom assembly.

More recently, there has been a trend away from mechanically operated valves to electrohydraulic valves that are operated by electrical signals. Electrical valve operation enables computerized control of the functions on the machine. In addition, hydraulic control now can be distributed throughout the machine by locating the valves for a given hydraulic function in close proximity to the hydraulic actuator, such as a cylinder, being operated by those valves. In the distributed hydraulic system, the operator in the cab of the tractor 18 manipulates joysticks or other input devices which send electrical signals to separate valve assemblies located adjacent each of the boom assembly cylinders 20, 22 and 24.

Such distributed control reduces the amount of hydraulic plumbing on the machine. In the case of the boom assembly 15, for example, only a single hydraulic fluid supply conduit and a single fluid return conduit are required to be run along that assembly in order to power the functions for pivoting the boom 16, the arm 14 and the bucket 12. In this case, the number of hydraulic conduits has been reduced to one third of those required in the traditional hydraulic control system.

Reducing the number of hydraulic conduits also reduces conduit failure and the machine maintenance.

However, distributed control is not without drawbacks. In traditional hydraulic systems, the pressure produced by the pump is controlled to meet the greatest pressure demand among all the hydraulic functions being operated at a given instant in time. The pressure demands are obtained by sensing the workport pressures at the mechanical valves on the chassis frame. A mechanism selects the highest workport pressure from among all the valves and uses that pressure to control the output pressure of the pump. Either a variable displacement pump is used, or an unloader valve or similar mechanism regulates the supply conduit pressure at the outlet of a fixed displacement pump. The supply conduit pressure usually is set some amount, referred to as the "margin", above the highest workport pressure to provide a differential pressure to meter oil from the output pressure of the pump to the workport pressure. This pump pressure control technique works satisfactorily in a hydraulic system with a centralized assembly of valves to which the actuators are connected by separate pairs of hydraulic conduits.

It has been found that a distributed hydraulic system, in which a common pair of supply and return conduits is connected to a plurality of hydraulic functions, that losses in different sections of the fluid distribution system affect operation of each of the hydraulic functions differently. For example, the loss in a hydraulic conduit section relatively near the tractor through which fluid flows to or from several hydraulic functions, affects the operation of all those functions, whereas the loss in a section through which fluid flow to or from only one hydraulic function affects operation of only that function. Furthermore, sensing the pressure at the hydraulic valves located in close proximity to the actuator being controlled does not adequately account for the conduit losses between that valve assembly and the tractor when determining the pressure level that the pump has to supply.

U.S. Pat. No. 6,718,759 describes a velocity based method for controlling a multiple function hydraulic system. That method is based on modeling each hydraulic function by an flow coefficient which represents the equivalent fluid conductance of the hydraulic branch in a selected metering mode. The equivalent conductance coefficient then is used along with the desired velocity for that function's hydraulic actuator, the metering mode and sensed pressures in the function to calculate individual valve conductance coefficients, that characterize fluid flow through each control valve of the function and thus the amount, if any, that each control valve is to open. Alternatively, this control method may be implemented using restriction coefficients, which are inversely related to the conductance coefficients, as both characterize the flow of fluid in a section or component of a hydraulic system. Conductance and restriction coefficients are generically referred to as "flow coefficients".

This method, based on deriving flow coefficients, requires that fluid at the proper pressure be supplied to the valve assembly at each hydraulic actuator. For optimal performance, this method requires knowledge of that pressure in order to achieve the requisite amount of fluid flow and thus operate the hydraulic actuator at the desired velocity. As a consequence with this type of system, losses in different sections of the supply and return conduits of the hydraulic system become very important.

SUMMARY OF THE INVENTION

A method is provided to operate a hydraulic system in a manner that compensates for fluid conduction losses between a source and a plurality of hydraulic actuators. A desired pressure level is established for each of the plurality of hydraulic actuators, which designates pressure that is required to operate the respective hydraulic actuator. Thus a plurality of desired pressure levels is established.

The fluid conduction losses that occur in the supply conduit between the fluid source and each of the plurality of hydraulic actuators is determined. In response to the fluid conduction losses, a calculation is performed to derive a supply pressure level required to be provided by the source in order that each of the plurality of hydraulic actuators receives its respective desired pressure level. The pressure at the source then is controlled in response to the supply pressure level.

One embodiment of this method operates a hydraulic system having a supply conduit connected to a source and having a return conduit connected to a tank, wherein the supply conduit has a plurality of first taps through which fluid flows to a plurality of hydraulic actuators. The embodiment involves deriving first pressure differentials which occur between adjacent first taps in the supply conduit and between the fluid source and one of the first taps. The method establishes a desired pressure level required at each tap of the supply conduit to operate the hydraulic actuator that is connected to the respective tap. In response to the first pressure differentials, a supply pressure level to be provided by the source is determined wherein that pressure level produced by the source results in the desired pressure level occurring at each tap of the supply conduit. The pressure at the source is controlled in response to the supply pressure level.

Another aspect of the present method involves using the supply pressure level produced at the source to calculate the actual pressure that occurs at each supply conduit tap.

A further aspect of this method entails sensing a pressure in the return conduit. A plurality of second pressure differentials is calculated, wherein each second pressure differential occurs between a pairs of second taps. Then a pressure level is calculated for each of the plurality of second taps based on the pressure in the return conduit and the plurality of second pressure differentials.

BRIEF DESCRIPTION OF THE DRAWINGS

FIG. 1 is a side view of a backhoe incorporating the present invention;

FIG. 2 is a schematic diagram of a hydraulic system for moving a boom, an arm and a bucket on the backhoe;

FIG. 3 shows an alternative hydraulic fluid source which may be used in the hydraulic system;

FIG. 5 is a flowchart illustrating a subroutine for calculating the fluid flows in sections of the supply and return conduits in the hydraulic system.

DETAILED DESCRIPTION OF THE INVENTION

Figure 4:
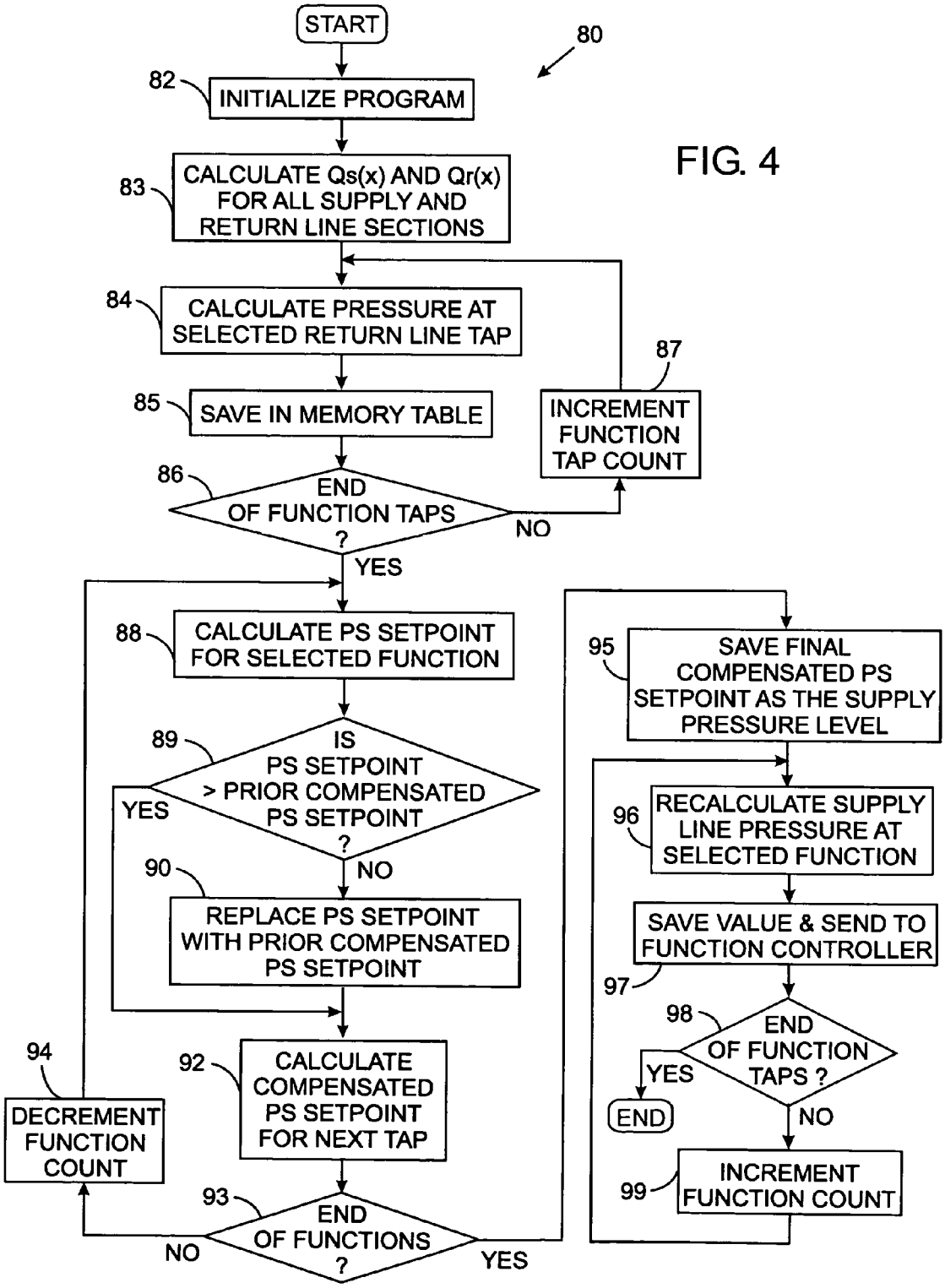
FIG. 4 is a flowchart depicting the method of calculating the control pressure for the pump and pressure in the supply and return conduits at each function of the hydraulic system.

Referring initially to FIGS. 1 and 2, a hydraulic system 30 for controlling operation of the backhoe boom assembly 15 includes a fluid source 31 that has a variable displacement pump 32 which draws fluid from a tank 34 and forces that fluid under pressure into a supply conduit 36. Alternatively as shown in FIG. 3, a fixed displacement pump may be used with an unloader valve or similar mechanism being provided to regulate the pressure in the supply conduit 36. The outlet pressure Ps(0) from the pump is measured by a first sensor 33 in FIG. 2. The supply conduit 36 furnishes the pressurized fluid to a boom function 37, an arm function 38, and a bucket function 39, which respectively operate the boom cylinder 20, the arm cylinder 22 and the bucket cylinder 24. Fluid returns from these three functions 37–39 to the tank 34 via a return conduit 40. The return pressure Pr(0) at the inlet to the tank 34 is measured by a second sensor 35. The supply conduit 36 and the return conduit 40 extend from the pump and tank 32 and 34 located in the tractor 18 of the backhoe 10 along both the boom 16 and the arm 14 to the three functions 37–39.

The present control method can be utilized on other types of machines, than just backhoes, and to control other functions than those associated with a boom assembly. In addition, a greater or lesser number of functions than that provided in system 30 can be controlled. Although the present method is being described in the context of an exemplary machine that employs hydraulic cylinders, it should be understood that the inventive concepts can be used with other types of hydraulic actuators, such as a motor that produces rotational motion, for example.

Separate taps are located are different points along the supply and return conduits 36 and 40 for connecting branch conduits of the functions 37–39. Each function 37–39 includes the associated hydraulic cylinder, a valve assembly and an electronic function controller. Specifically, the boom function 37 has a first valve assembly 42 that selectively applies the pressurized fluid from the supply conduit 36 to one of the chambers of the boom cylinder 20 and drains fluid from the other cylinder chamber to the return conduit 40. A second valve assembly 44 in the arm function 38 controls the flow of hydraulic fluid to and from the arm cylinder 22 and the supply and return conduits 36 and 40. The bucket function 39 has a third valve assembly 46 that couples the chambers of the bucket cylinder 24 to the supply and tank conduits 36 and 40. Each of the valve assemblies, 42, 44 and 46 is located adjacent the respective hydraulic cylinder 20, 22 and 24 to form a distributed control system. Any of a number of conventional configurations of electrical operated valve elements can be employed in each valve assembly 42, 44 and 46, such as the elements described in U.S. Pat. No. 6,328,275.

Operation of the valve assemblies 42, 44, and 46 are controlled by a separate function controller 48, 50 and 52, respectively. Each function controller is co-located along the boom assembly 15 with the associated valve assembly. The respective function controller 48, 50 and 52 operates the valves in the associated valve assembly 42, 44 and 46 so that the corresponding cylinder 20, 22 and 24 moves as commanded by the backhoe operator. To accomplish this operation, each function controller 48, 50 and 52 receives commands from a system controller 54 via a communication network 56, such a Controller Area Network (CAN) serial bus that uses the communication protocol defined by ISO 11898 promulgated by the International Organization for Standardization in Geneva, Switzerland.

The function controllers 48, 50 and 52 and the system controller 54 are microcomputer based devices that execute software programs which perform specific tasks assigned to the respective controller. The system controller 54 supervises the overall operation of the hydraulic system 30. In particular, the system controller 54 receives operator input signals from joysticks 58, pressure sensors 33 and 35, and other input devices on the backhoe 10. In response to those signals, the system controller 54 sends data and operational commands via the communication network 56 to instruct the function controllers 48, 50 and 52 how to operate the associated valve assembly and thus the respective hydraulic cylinder. The system controller 54 also operates the variable displacement pump 32 to produce the necessary pressure in the supply conduit 36, as will be described. Alternatively, a separate pump controller can be connected to the communication network 56 to specifically govern the operation of the pump and other components of the fluid source 31.

For example, to produce movement of a given hydraulic cylinder 20, 22 and 24 on the boom assembly 15, the backhoe operator manipulates the corresponding joystick 58 to indicate the desired velocity at which that cylinder is to move. The signal from that joystick 58 is applied to the system controller 54 which produces a cylinder velocity command that is transmitted via the communication network 56 to the function controller for the function associated with the particular cylinder.

Each function controller 48, 50 and 52 responds to the cylinder velocity commands from the system controller 54 and to pressures sensed at the ports of the associated valve assembly 42, 44 or 46, respectively, by determining how to operate that valve assembly in order to achieve the commanded velocity of the designated cylinder. Specifically, a given function controller 48, 50 and 52 responds to those input signals by deriving an equivalent flow coefficient which characterizes either fluid flow resistance or the conductance of the conduits, valves, cylinder and other hydraulic components in the associated function. This process also determines a desires pressure level that each function requires in order to operate at the commanded velocity. From the equivalent flow coefficient, a separate valve flow coefficient is derived for each valve element in the corresponding valve assembly 42, 44 and 46. The valve flow coefficients define the degree to which the respective valve element must open to provide the requisite amount of fluid flow to the hydraulic cylinder 20, 22 and 24 being operated. Based on each valve flow coefficient, an electrical current is produced and applied to the electrical operator for the corresponding valve element. The operation of the system controller 54 and the function controllers 48, 50 and 52 is described in U.S. Pat. No. 6,718,759, which description is incorporated by reference herein.

Because this control paradigm utilizes flow parameters, losses and other characteristics of the supply and return conduits 36 and 40 which affect fluid flow also affect the accuracy at which each function's operation is controlled. Therefore, the present control method characterizes the flow losses which occur in different sections of the supply and return conduits 36 and 40 and assesses the effect that those losses have on the control of each function. The system controller 54 in the present hydraulic system 30 improves upon the previous velocity based control method by taking into account the pressure losses in various sections of the hydraulic conduits between the pump and tank 32 and 34 and the three valve assemblies 42, 44 and 46 for the boom assembly 15.

With specific reference to FIG. 2, the supply conduit 36 and the return conduit 40 comprise a plurality of sections. A first section 63 of the supply conduit 36 extends between the pump 32 and a first tap 60 where the boom function 37 is connected. The flow loss in the first section 63, and the other sections to be described, is graphically represented in the drawing as an orifice and the flow through this first section is designated as Qs(1), where the "s" indicates the supply conduit. A flow conductance coefficient of the supply conduit first section 63 is designated Kvs(1). A second section 64 of the supply conduit 36 extends between the first tap 60 and a second tap 61 for the arm function 38. This second section 64 has a fluid flow designated Qs(2) and a flow coefficient Kvs(2). The third section 65 of the supply conduit 36 extends between the second tap 61 and the third tap 62 to which the bucket function 39 connects. The third section 65 is characterized by a fluid flow Qs(3) and a flow coefficient Kvs(3). Although the present implementation of the novel control method employs flow conductance coefficients, similar coefficients representing flow resistance alternatively may be used. Additionally compensations for temperature could be added to improve the fidelity of the loss calculation.

Each conduit between one of the supply conduit taps and the valve assembly for a function also has losses. The supply branch conduit 66 for the boom cylinder 20 carries a flow Qsf(1) and is depicted by flow coefficient Kvsf(1), where "f" denotes that the parameters relate to a function branch. The arm function 38 has a supply branch conduit 68 that is characterized by a fluid flow Qsf(2) and a flow coefficient Kvsf(2). Likewise the supply branch conduit 69 for the bucket function 39 has flow designated Qsf(3) and a flow coefficient Kvsf(3).

The return conduit 40 also is segmented into a number of sections 73, 74 and 75 defined between the source 31 and the taps 70, 71 and 72 for the three functions 37–39. The flow through a first section 73 of the return conduit 40 between a first tap 70 for the boom function 37 and the tank 34 is designated Qr(1) and is characterized by a flow coefficient Kvr(1), where "r" designates the return conduit. A second return conduit section 74 extends between the first tap 70 and a second tap 71 for the arm function 38 and is represented by a flow Qr(2) and by a flow coefficient Kvr(2). The third section 75 of the return conduit 40 is located between the second and third taps 71 and 72 and is characterized by the flow coefficient Kvr(3) and a flow Qr(3).

The branch conduit 76 carrying fluid between the boom function 37 and the first tap 70 of the return conduit carries a flow Qrf(1) and is characterized by the flow coefficient Kvrf(1). The return branch conduit 78 from the arm function 38 to the second tap 71 is designated by the flow coefficient Kvrf(2) and a flow Qrf(2). The return branch conduit 79 for the bucket function 39 has a flow Qrf(3) and a flow coefficient Kvrf(3). Note that the direction of flow in the return conduits sections 73, 74 and 71 and in the return branch conduits 76, 78 and 79, as denoted by the arrows, has been arbitrarily defined as from the tank into toward the functions, however the flow could just as well have been defined in the opposite direction.

The determination of the losses 83 in different sections of the supply and return conduits 36 and 40 is performed by a software routine that is periodically executed by the system controller 54. Then the losses are used to determine the pressure that must be furnished by the pump 32 in order to overcome those losses so that each function receives fluid at the pressure required for proper operation. The software routine 80 is depicted in FIG. 4 and commences at step 82 by initializing the variables, counters and other parameters used during its execution. Next at step 83, the routine calculates the flow Qs(x) in each section of the supply conduit 36 and the fluid flow Qr(x) in each section of the return conduit 40, where x numerically denotes a particular section. These flows are a function of the flow that each function contributes to each section of the supply and return conduit. For example, the flow in the first return conduit section 73 is the sum of the flows Qrf(1)–Qrf(3) in each of the return branch conduits 76, 78 and 79 for the three functions 37–39. In contrast, the flow in the third return conduit section 75 is only the flow Qrf(3) in return branch conduit 79 for the bucket function 39. It should be noted that flow in each return branch conduit 76, 78 and 79 may be positive or negative depending upon whether the particular function 37–39 is sending fluid into the return conduit or is drawing fluid from the return conduit as can occur in a regeneration mode. For the same reason, the flow in each supply branch conduit 66, 68 and 69 may be positive or negative.

The calculation of flow in the supply and return conduit sections at step 83 is depicted by the flow chart of FIG. 5 which commences at step 100 by setting a function count, X, equal to one. Then at step 102, the flow Qs(1) in the first supply conduit section 63 is calculated by summing the flows Qsf(1) through Qsf(3) in each of the three function supply branches 66, 68 and 69. Note that the present value of the function count X is one and the total number of function branches, n, is three in the exemplary hydraulic system 30. A similar calculation then is performed at step 104 for the flow in the first return conduit section 73 by summing the flows Qrf(1) through Qrf(3) in each of the function return branches 76, 78 and 79. The values for the supply and return branch flows either are obtained from the respective function controller 48, 49 and 52 or are calculated by the system controller 54 from the commanded velocity, the metering mode and the cylinder piston areas of each function 37–39. At step 105, the newly calculated values for Qs(x) and Qr(x) for the present sections of the supply and return conduits 36 and 40 are stored in a data table within the memory of the system controller 54. The function count X is incremented at step 106 and a determination is made at step 108 whether that new function count exceeds the number (n) of functions of the hydraulic system, as occurs when the flows have been calculated for all the supply and return conduit sections. If not, the flow calculation subroutine returns to step 102 to derive the flows Qs(x) and Qr(x) for the next sections of the supply and return conduits 36 and 40. When all the flow calculations have been made, the function count is reset to one at step 110 before the subroutine terminates and program execution returns to the main software routine 80.

Referring again to FIG. 4, the execution of the main routine 80 advances to a first portion which calculates the pressure at each of the taps 70, 71 and 72 in the return conduit 40. The pressure at each tap of the return conduit is normally greater than at the adjacent that is closer to the tank because of the loss in the section of the return conduit between those two taps. Likewise, the pressure at the first tap 70 is normally greater than the pressure at the tank 34 which is measured by the second pressure sensor 35. The calculation of the tap pressures commences at step 84 with the first tap 70 closest to the tank 34 and then progresses sequentially along the return conduit 40 going away from the tank computing the pressure at each successive tap 71 and 72. In cases where there is a negative tap flow, the pressures can decrease between two taps.

The pressure at a given tap is based on the pressure differential AP in the adjacent return conduit section as given by the expression:

$$\sqrt{\Delta P} = \frac{Qr(x)}{Kvr(x)} \tag{1}$$

where X is the function count which designates the number of the tap at which the pressure is being calculated, e.g. X=1 at this point in time. Expression (1) can be restated in the following manner which preserves the sign of the pressure differential:

$$\Delta P = \left|\frac{Qr(x)}{Kvr(x)}\right| * \left(\frac{Qr(x)}{Kvr(x)}\right). \tag{2}$$

Therefore, the pressure Pr(x) at tap x is calculated according to the equation:

$$Pr(x) = Pr(x-1) - \left|\frac{Qr(x)}{Kvr(x)}\right| * \left(\frac{Qr(x)}{Kvr(x)}\right). \tag{3}$$

Pr(x−1) is the pressure at a point in the return conduit that is closer to the tank. For the first return conduit tap 70 where x=1, Pr(x−1) is the pressure Pr(0) measured by the second sensor 35 and for the other return conduit taps 71 and 72, Pr(x−1) is the previously calculated tap pressure. When the pressure has been calculated for a given tap, that value is stored in a memory table at step 85 for future use.

At step 86, a determination is made whether pressure has been calculated for all the return conduit taps, i.e. whether X equals the number of the last function tap (e.g. X=3). If there is one or more return conduit tap remaining, the execution branches to step 87 where the tap count is incremented before returning to step 84 to calculate the pressure at the next return conduit tap going away from the tank 34. When pressures at all the return taps have been calculated, the program execution advances to step 88.

At this juncture, the system controller 54 begins executing a second portion of the software routine 80 in which the desired outlet pressure of the pump 32 is derived based on the pressure requirements of the three functions 37–39. That desired pump outlet pressure must be greater than the greatest pressure desired, or demanded, by the functions because of the losses in the supply conduit 36. This portion of the software routine 80 initially calculates the pressure required by the function having its tap located farthest along the supply conduit from the pump 32 and then sequentially progresses along the supply conduit 36 toward the pump calculating the pressure required by each successive function. Each stage of this progressive process also calculates the pressure that must occur at the selected tap in order to satisfy the pressure desired for functions farther downstream along the supply conduit form the pump. The greater of the pressure demanded by the function for the selected tap and the pressure required by the downstream taps is used in the next calculation iteration. The result of these progressive calculations is a desired pump outlet pressure that then is used to control the pump 32.

This second portion of the software routine 80 commences upon a transition from step 86 to step 88 in FIG. 4. When that happens, the function count points to the function farthest from the pump, which in the exemplary system is the bucket function 39 (x=3). The first step 88 calculates the supply pressure setpoint which indicates the pressure required by the selected function (e.g. initially the bucket function 39). The system controller 54 derives the supply pressure setpoint (PS setpoint) according to one of the following equations depending upon which metering mode has been chosen by the associated function controller 48, 50 and 52:

Powered Extension Mode:

$$Ps\ \text{setpoint} = \frac{\dot{x}^2 Ab^2}{RKeq^2} - \frac{(Pb - Pr)}{R} + Pa,\ \dot{x} > 0 \tag{4}$$

Powered Retraction Mode:

$$Ps\ \text{setpoint} = \frac{\dot{x}^2 Ab^2}{Keq^2} - R(Pa - Pr) + Pb,\ \dot{x} < 0 \tag{5}$$

High Side Regeneration:

$$Ps\ \text{setpoint} = \frac{\dot{x}^2 Ab^2}{(R-1)Keq^2} + \frac{RPa - Pb}{R-1},\ \dot{x} > 0 \tag{6}$$

Low Side Regeneration:

$$Pr\ \text{setpoint} = \frac{\dot{x}^2 Ab^2}{(R-1)Keq^2} + \frac{RPa - Pb}{R-1},\ \dot{x} > 0 \tag{7}$$

where $\dot{x}$ is the desired velocity of the associated cylinder piston, Keq is the equivalent flow conductance coefficient for the selected function, Ab is the piston area in the rod cylinder chamber, R is the ratio of the piston area in the head cylinder chamber to the piston area in the rod cylinder chamber, Pa is the head chamber pressure, Pb is the rod chamber pressure, and Pr is the return conduit pressure. The chosen metering mode, equivalent flow conductance coefficient and required pressure values are obtained by the system controller 54 from the respective function controller 48, 50 and 52. In the powered extension and retraction metering modes, fluid from the supply conduit 36 is applied to one cylinder chamber and all the fluid exhausting from the other cylinder chamber flows into the return conduit 40. In the high side regeneration mode, fluid exiting one cylinder chamber is supplied to the other cylinder chamber through a node of the valve assembly that is connected to the supply conduit 36. In the low side regeneration mode, fluid exiting one cylinder chamber is supplied to the other cylinder chamber through a node of the valve assembly that is connected to the return conduit 40. Alternatively the calculation of the Ps setpoint can be performed at each function controller 48, 50 and 52 and communicated to the system controller 54 via the communication network 56 to reduce the computations that the system controller must perform.

The pump supply setpoint denotes the desired pressure that needs to occur at the supply conduit tap for the respective function in order for that function to operate at the commanded velocity. However, the pressure at each supply conduit tap also must be great enough to satisfy the demands of the other functions downstream along the supply conduit 36. The downstream pressure demand is designated as the compensated Ps setpoint for a given tap location and is calculated as part of the computations performed for each supply conduit tap 60–62. The compensated Ps setpoint for the bucket function 39 and tap 62 which are farthest from the pump is zero. Therefore, the determination at step 89 whether the Ps setpoint for the selected function is greater than the previously calculated compensated Ps setpoint results in the program execution jumping around step 90 to step 92. For subsequent taps 70 or 71, the determination at step 89 may be false (NO) where a downstream function requires that a greater pressure occur at the upstream tap than is demanded by the function connected to that upstream tap. In this case, the software routine executes step 90 and replaces the newly calculated Ps setpoint for the present function with the previously calculated compensated Ps setpoint derived from the pressure demanded by another function.

At step 92, a compensated Ps setpoint for the next upstream tap (x−1) is calculated using the current Ps setpoint and the loss in the adjacent supply conduit section going toward the pump 32. This calculation employs the equation:

$$\text{Compensated } Ps\ \text{setpoint}(x-1) = Ps\ \text{setpoint}(x) + \left|\frac{Qs(x)}{Kvs(x)}\right| * \left(\frac{Qs(x)}{Kvs(x)}\right) \tag{8}$$

where x is the function count which designates the current tap and the adjacent section of the supply conduit 36.

Then at step 93 a determination is made whether this computation has been performed for all the functions 37–39. If that is not the case, execution of the software routine 80 branches to step 94 where the function count is decremented to select next function closest toward the pump 32 along the supply conduit 36. The execution then returns to step 88 to repeat the derivation of the PS setpoint and the compensated PS setpoint for the newly selected function.

When the computations in the second portion of the software routine 80 are complete, the final compensated PS setpoint designates the pressure that must be produced at the outlet of the pump 32 to satisfy the demands of all the functions 37–39. Specifically that is the pump outlet pressure which is required to meet the demand of the function requiring the greatest pressure, taking the supply conduit losses into account. That final compensated PS setpoint is stored at step 95 as the supply pressure level that the system controller uses to operate the variable displacement pump 32 in the fluid source 31.

Operation of the fluid source 31 to provide the supply pressure level at the outlet of the pump 32 results in typically lower pressure occurring at each supply conduit tap 60–62 due to the losses in the various sections 63–65 of the supply conduit 36. In order to properly control the valve assemblies 42, 44 and 46, the function controllers 48–50 have to know the actual pressure appearing at its respective supply conduit tap 60–62. The system controller 54 also should know these tap pressures. For this purpose, the software routine 80 branches from step 93 to step 96, at which time the function count is one (x=1), designating the boom function 37 and the first supply conduit tap 60. The resultant pressure at each tap then is calculated from the supply pressure level by taking the supply conduit losses into account. Initially the pump setpoint pressure, corresponding to the compensated PS setpoint Ps(0), and the flow coefficient Kvs(1) and the flow Qs(1) for the first supply conduit section 63 are employed to derive the actual pressure setpoint Ps(1) that occurs at the first tap 60. That derivation uses the equation:

$$Ps(x) = Ps(x-1) - \left|\frac{Qs(x)}{Kvs(x)}\right| * \left(\frac{Qs(x)}{Kvs(x)}\right) \quad (9)$$

where x designates the selected function and supply conduit tap. This calculated supply conduit pressure setpoint Ps(x) is saved in a memory table and sent via the communication network 56 to the respective function controller at step 97. Next a determination is made at step 98, whether pressure setpoints have been calculated for all the supply conduit taps 60–62, if so, execution of the software routine 80 ends. Otherwise, the execution branches to step 99 where the function count is incremented before returning to step 96 to calculate the pressure setpoint for the next function.

When, the software routine 80 terminates, the supply pressure level sets a setpoint pressure for the pump at which all the functions 37–39 will receive sufficient pressure to perform as commanded by the operator of the backhoe 10. In addition, each the function controller 48, 50 and 52 has been informed of the resultant actual pressure at appearing at its taps of the supply and return conduits 36 and 40, and uses those that pressure information in operating the corresponding valve assembly 42, 44 and 46 to produce the desired velocity and operation of the hydraulic cylinder 20, 22 and 24 being controlled.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A method for operating a hydraulic system having a supply conduit connected to a source, wherein the supply conduit has a plurality of first taps through which fluid is supplied to a plurality of hydraulic actuators, the method comprising:

deriving a plurality of first pressure differentials between adjacent first taps in the supply conduit and between the fluid source and one of the first taps;

establishing a desired pressure level required at each tap of the supply conduit to operate the hydraulic actuator that is connected to that respective tap;

in response to the plurality of first pressure differentials, determining a supply pressure level to be provided by the source in order that the desired pressure level occurs at each tap of the supply conduit; and controlling pressure at the source in response to the supply pressure level.

2. The method as recited in claim 1 wherein each first pressure differential is derived by determining an amount of fluid flow between a pair of first taps, and calculating a first pressure differential in response to the amount of fluid flow and a flow coefficient for a section of the supply conduit between the pair of first taps.

3. The method as recited in claim 1 wherein deriving a plurality of first pressure differentials comprises:

(a) determining a fluid flow between a pair of first taps of the supply conduit;

(b) calculating a first pressure differential in response to the fluid flow and a flow coefficient for a section of the supply conduit between the pair of first taps; and (c) repeating steps (a) and (b) for other pairs of first taps of the supply conduit.

4. The method as recited in claim 1 further comprising calculating a pressure level at each first tap in response to the supply pressure level.

5. The method as recited in claim 4 wherein calculating a pressure level comprises for each pair of adjacent first taps:

determining a fluid flow between that pair of adjacent first taps; and calculating a pressure differential utilizing the fluid flow and a flow coefficient for a section of the supply conduit between that pair of adjacent first taps.

6. The method as recited in claim 5 wherein calculating a pressure level further comprises employing a pressure differential and pressure at one first tap of the pair to calculate a pressure at another first tap of the pair.

7. The method as recited in claim 1 further comprising:

sensing a pressure in the return conduit;

in response to the pressure in the return conduit, calculating a pressure level for each of a plurality of second taps through which fluid flows between the plurality of hydraulic actuators and a return conduit coupled to a tank.

8. The method as recited in claim 1 wherein fluid flows between the plurality of hydraulic actuators and a return conduit through a plurality of second taps, and further comprises:

sensing a pressure in the return conduit;

calculating a plurality of second pressure differentials, wherein each second pressure differential occurs between a pair of second taps; and calculating a pressure level for each of the plurality of second taps based on the pressure in the return conduit and the plurality of second pressure differentials.

9. The method as recited in claim 8 wherein the calculating each second pressure differential is based on a fluid flow between the pair of second taps and a flow coefficient for a section of the return conduit between the pair of second taps.

10. A method for operating a hydraulic system to compensate for fluid losses in a conduit between a source and a plurality of hydraulic actuators, that method comprising:

establishing a desired pressure level for each of the plurality of hydraulic actuators, thereby establishing a plurality of desired pressure levels;

determining conduction characteristics of the conduit between the fluid source and each of the plurality of hydraulic actuators;

in response to the conduction characteristics, the plurality of desired pressure levels and a pressure level in the conduit proximate the source, calculating a separate pressure level available in the conduit for each hydraulic actuator; and controlling each hydraulic actuator in response to a respective separate pressure level.

11. The method as recited in claim 10 wherein the conduction characteristics specify pressure differentials between selected points in the conduit.

12. The method recited in claim 10 wherein determining each conduction characteristic comprises:

calculating a level of fluid flow between a pair of points in the conduit; and calculating a pressure differential in response to the level of fluid flow and a flow coefficient for a section of the conduit between the pair of points.

13. The method as recited in claim 10 wherein determining conduction characteristics comprises determining a fluid conduction loss in each conduit section between points at which the plurality of hydraulic actuators are connected to the conduit.

14. The method as recited in claim 10 further comprising calculating a desired source pressure level to be provided by the source.

15. The method as recited in claim 14 wherein calculating a desired source pressure level is in response to the plurality of desired pressure levels and the conduction characteristics.

16. The method as recited in claim 14 further comprising controlling pressure at the source in response to the desired source pressure level.

17. The method as recited in claim 10 wherein calculating a separate pressure level comprises:

defining a plurality of points in the conduit; and for each pair of adjacent points in the conduit:

(a) determining a fluid flow between that pair of adjacent points, and (b) calculating a pressure differential utilizing the fluid flow and a flow coefficient for a section of the conduit between that pair of adjacent points.

18. The method as recited in claim 17 wherein calculating a separate pressure level further comprises employing a pressure differential and pressure at one point in the pair of adjacent points in the conduit to calculate pressure at another point in the pair of adjacent points.

19. A method for operating a hydraulic system having a supply conduit connected to a source and a return conduit connected to a tank, wherein the source and a plurality of hydraulic actuators are coupled to the supply conduit at different first points, the method comprising:

(a) determining a fluid flow between a pair of the first points;

(b) calculating a first pressure differential in response to the fluid flow and a flow coefficient for a section of the supply conduit between the pair of first points;

(c) repeating steps (a) and (b) for other pairs of first points of the supply conduit, thereby calculating a plurality of first pressure differentials;

(d) for each of the plurality of hydraulic actuators, establishing a desired pressure level for operating that respective hydraulic actuator;

(e) designating the first point, that is farthest from the source, as a selected first point;

(f) calculating a compensated pressure level as a function of one of the plurality of first pressure differentials and the desired pressure level for the hydraulic actuator coupled to the selected first point;

(g) redesignating another first point, that is closer to the source than the selected first point, as the selected first point;

(h) selecting as a selected pressure level the compensated pressure level or the desired pressure level for the hydraulic actuator coupled to the selected first point, whichever is greater;

(i) recalculating the compensated pressure level as a function of one of the plurality of first pressure differentials and the selected pressure level;

(j) repeating steps (g) through (i) for all the first points to which a hydraulic actuator is coupled;

(k) then designating the compensated pressure level as a source pressure level; and (l) using the source pressure level to control pressure provided by the source.

20. The method as recited in claim 19 further comprising, in response to the source pressure level, calculating a resultant pressure level at each point at which a hydraulic actuator is coupled to the supply conduit.

21. The method as recited in claim 20 wherein calculating a resultant pressure level comprises for each pair of adjacent points in the supply conduit:

determining a fluid flow between that pair of adjacent points; and calculating a pressure differential utilizing the fluid flow and a flow coefficient for a section of the supply conduit between that pair of adjacent points.

22. The method as recited in claim 21 wherein calculating a resultant pressure level further comprises employing a pressure differential and pressure at one point in the pair of adjacent points in the supply conduit to calculate pressure at another point in the pair of adjacent points.

23. The method as recited in claim 19 wherein the return conduit has a plurality of second points through which fluid flows from the plurality of hydraulic actuators, and further comprising:

sensing a pressure in the return conduit;

calculating a plurality of second pressure differentials, each occurring between a different pair of second points; and calculating a return pressure level for each of the plurality of second points based on the pressure in the return conduit and the plurality of second pressure differentials.

24. The method as recited in claim 23 wherein the calculating a second pressure differential is based on a fluid flow between the pair of second points and a flow coefficient for a section of the return conduit between the pair of second points.

* * * * *